US005740261A

United States Patent [19]

Loeppert et al.

[11] Patent Number: 5,740,261

[45] Date of Patent: Apr. 14, 1998

[54] MINIATURE SILICON CONDENSER MICROPHONE

[75] Inventors: Peter V. Loeppert, Hoffman Estates; David E. Schafer, Glen Ellyn, both of Ill.

[73] Assignee: Knowles Electronics, Inc., Itasca, Ill.

[21] Appl. No.: 752,584

[22] Filed: Nov. 21, 1996

[51] Int. Cl.[6] ..... H04R 25/00

[52] U.S. Cl. ..... 381/168; 381/169; 381/189

[58] Field of Search ..... 381/168, 169, 381/173, 191, 189; 310/324; 257/659, 660; 174/52.4

[56] References Cited

U.S. PATENT DOCUMENTS

| | | | |
|---|---|---|---|
| 4,705,659 | 11/1987 | Bernstein et al. | 264/29.6 |
| 4,793,821 | 12/1988 | Muller et al. | 381/173 |
| 5,006,749 | 4/1991 | White | 310/323 |
| 5,146,435 | 9/1992 | Bernstein | 367/181 |
| 5,178,015 | 1/1993 | Loeppert et al. | 73/718 |
| 5,203,208 | 4/1993 | Bernstein | 73/505 |
| 5,212,988 | 5/1993 | White et al. | 73/599 |
| 5,216,490 | 6/1993 | Grieff et al. | 73/517 R |
| 5,303,210 | 4/1994 | Bernstein | 367/181 |
| 5,317,107 | 5/1994 | Osorio | 174/52.4 |
| 5,335,210 | 8/1994 | Bernstein | 367/163 |
| 5,406,117 | 4/1995 | Klugokecki et al. | 257/659 |
| 5,490,220 | 2/1996 | Loeppert | 381/168 |
| 5,635,754 | 6/1997 | Strobel et al. | 257/659 |

FOREIGN PATENT DOCUMENTS

WO 95/34917 12/1995 WIPO .

*Primary Examiner*—Sinh Tran

*Attorney, Agent, or Firm*—Wallenstein & Wagner, Ltd.

[57] ABSTRACT

A housing for shielding a transducer of the type mounted on a silicon die attached to a flexible circuit. The housing provides a jacket which protects the silicon die from physical damage. The jacket, in cooperation with the top and bottom cups, further provides a shield for the silicon die from light and electromagnetic interferences. An acoustic port located on the top portion of the jacket furnishes the means by which acoustic energy enters the jacket to contact the transducer. A back cavity, formed between the bottom cup and the silicon die, serves as the acoustic pressure reference which allows the microphone to function properly.

38 Claims, 4 Drawing Sheets

MINIATURE SILICON CONDENSER MICROPHONE

TECHNICAL FIELD

The present invention relates generally to a housing for a transducer. More particularly, this invention relates to a miniature silicon condenser microphone comprising a housing for shielding a transducer produced on the surface of a silicon die. The silicon die must be packaged to produce a functional microphone of this type.

BACKGROUND

There have been a number of disclosures on how to build microphone elements on the surface of a silicon die. Certain of these disclosures have come in connection with the hearing aid field for the purpose of reducing the size of the hearing aid unit. While these disclosures have reduced the size of the hearing aid, they have not disclosed how to protect the transducer from outside interferences. For instance, transducers of this type are fragile and susceptible to physical damage. Furthermore, they must be protected from light and electromagnetic interferences. Moreover, they require an acoustic pressure reference to function properly. For these reasons the silicon die must be shielded. Thus, it is an object of the present invention to provide a housing for a transducer built on the surface of a silicon die that allows acoustic energy to contact the transducer and provides the necessary pressure reference while at the same time protects the die from light, electromagnetic interference, and physical damage.

SUMMARY OF THE INVENTION

The present invention is a miniature silicon condenser microphone that includes a housing for shielding a transducer built on a silicon die. The housing is necessary to protect the transducer from outside interference and to allow the microphone to function properly. The housing includes a jacket, a bottom cup, and a top cup. The bottom cup and silicon die cooperate to define a back cavity. These elements function in combination to protect the silicon die while allowing the transducer to receive acoustic energy and process it accordingly.

The jacket serves as the container for the other elements. It is the shield which ultimately protects the delicate silicon die. The jacket is characterized by a thin cylindrical shell with an opening at one end corresponding generally to the inner diameter of the cylindrical shell. The end opposing the opening or top portion contains a smaller opening or acoustic input port through which the acoustic energy enters the jacket to contact the transducer.

The bottom cup serves many purposes. It has a curved surface which contacts an inner surface of the jacket's cylindrical shell. A light barrier or upper portion of the bottom cup engages the top portion of the jacket protecting the jacket's interior from light which enters through the acoustic input port while at the same time allowing acoustic energy to enter the jacket. The sealing member or lower portion of the bottom cup helps prevent light from entering the jacket's opening and works in conjunction with the light barrier to fix the silicon die in position.

The top cup works with the bottom cup to fix the silicon die in place and prevent light from entering the jacket. The top cup has a curved outer surface for engaging the inner surface of the jacket's cylindrical shell. An open end mates with the light barrier to form an optical baffle through which the acoustic energy travels to reach the transducer. A closed end mates with the silicon die at the jacket's opening to seal the jacket and prevent light from entering the housing.

The back cavity is formed between the bottom cup and the silicon die. It provides the acoustic pressure reference necessary for the microphone to function properly as an omnidirectional unit. A directional microphone can be built by venting the back cavity opposite to the acoustic input port.

For a better understanding of the invention, reference may be made to the following specification taken in conjunction with the following drawings. Furthermore, other features and advantages of the invention will be apparent from the following specification taken in conjunction with the following drawings,

DETAILED DESCRIPTION

Figure 1:
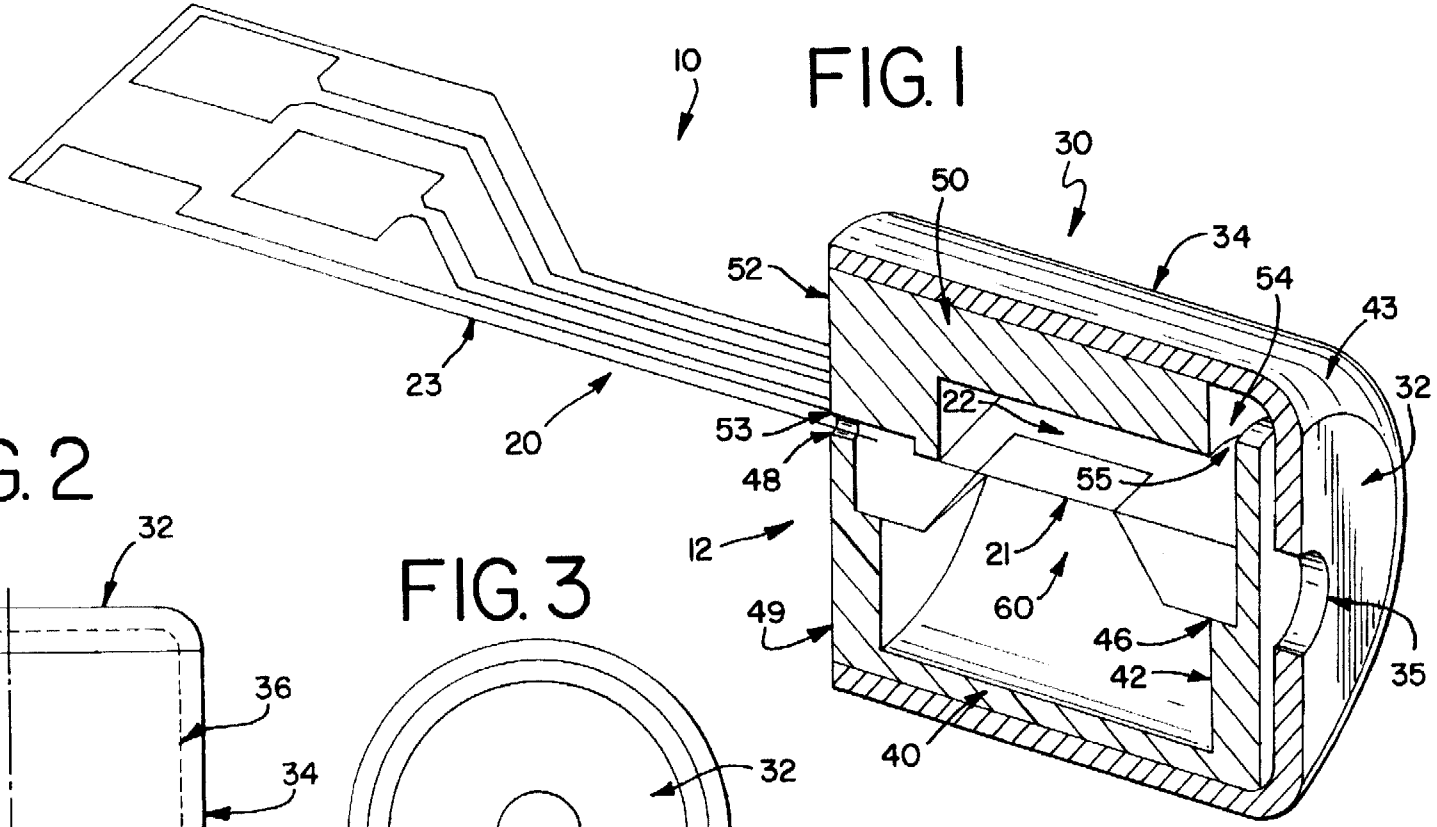
FIG. 1 is a perspective drawing of the miniature silicon condenser microphone in a cut-away side view.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

Referring first to FIG. 1, a miniature silicon condenser microphone 10 is disclosed. The microphone 10 includes a housing 12 for shielding a transducer 21 of the type built on a silicon die 22 and attached to a flexible circuit 23. The housing 12 comprises a jacket 30 which provides an enclosure for the remaining elements—a bottom cup 40, a top cup 50, and a back cavity 60.

Figure 3:
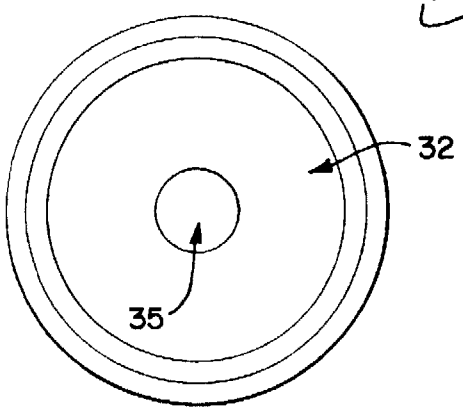
FIG. 3 is a schematic drawing of the top view of the jacket.
Figure 2:
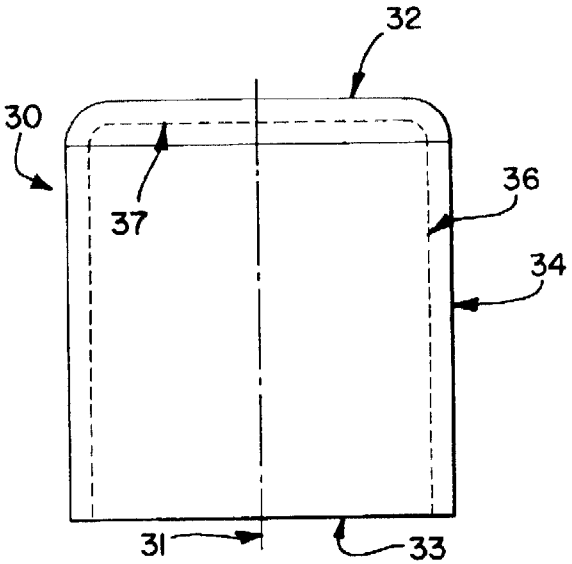
FIG. 2 is a schematic drawing of a side view of the jacket.
Figure 5:
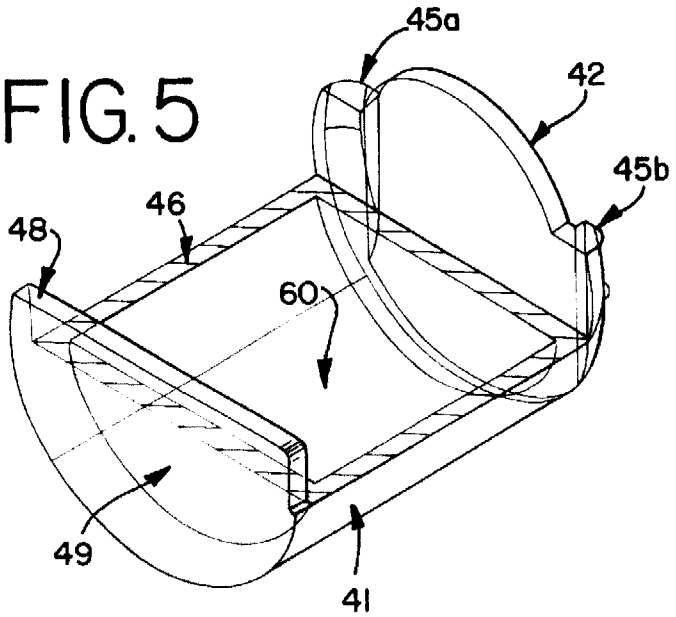
FIG. 5 is a perspective drawing of the bottom cup.
Figure 7:
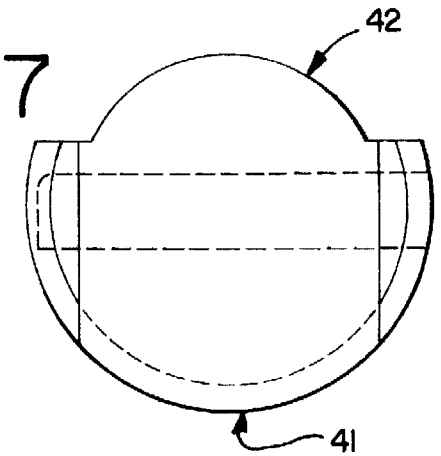
FIG. 7 is a schematic drawing of a front view of the top cup.
Figure 4:
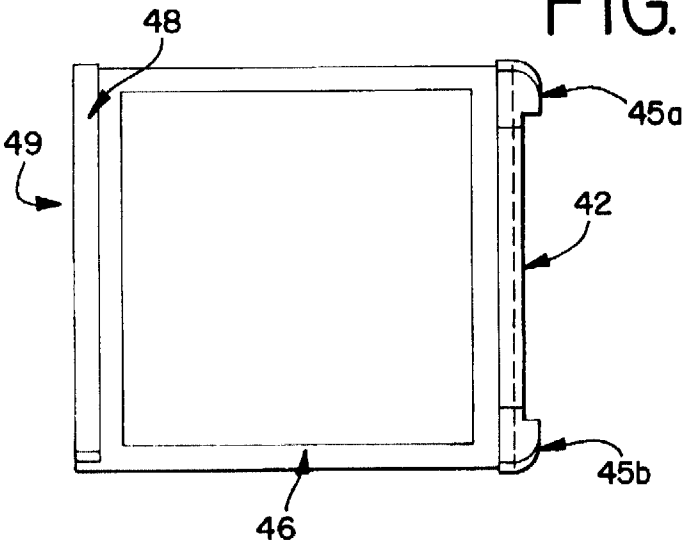
FIG. 4 is a schematic drawing of a top view of the bottom cup.
Figure 6:
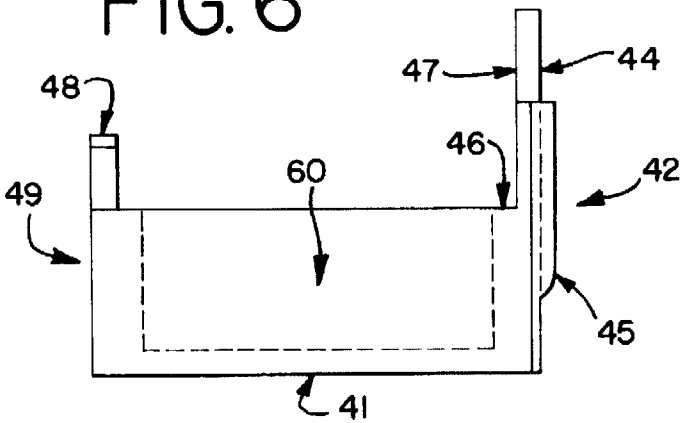
FIG. 6 is a schematic drawing of the bottom cup side view, rotated 90 degrees off the top view of FIG. 4.
Figure 9:
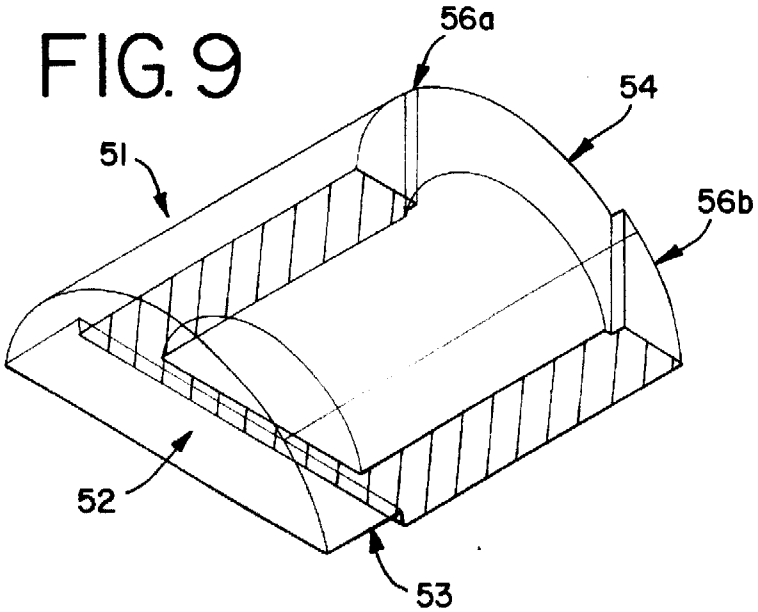
FIG. 9 is a perspective drawing of a top view of the top cup.
Figure 11:
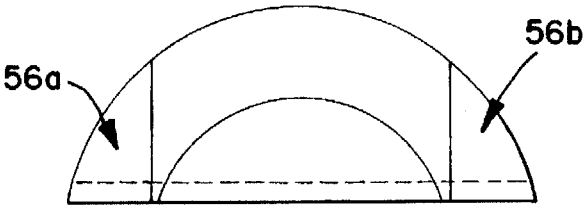
FIG. 11 is a schematic drawing of the open end of the top cup.
Figure 8:
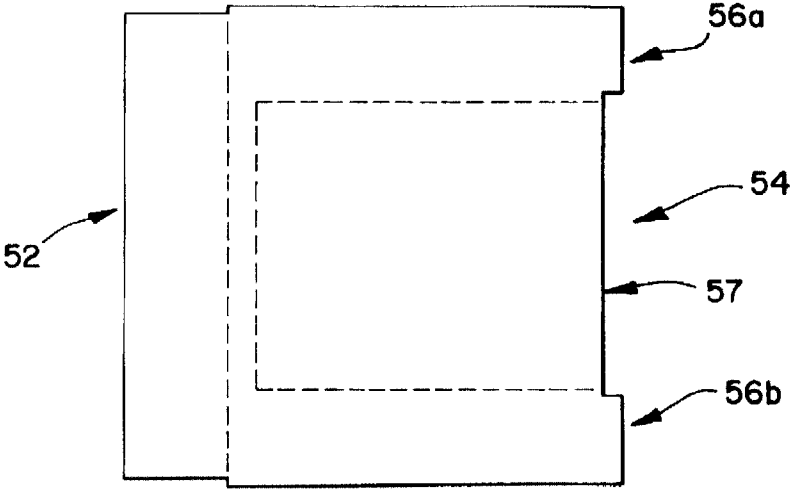
FIG. 8 is a schematic drawing of the top view of the top cup.
Figure 10:
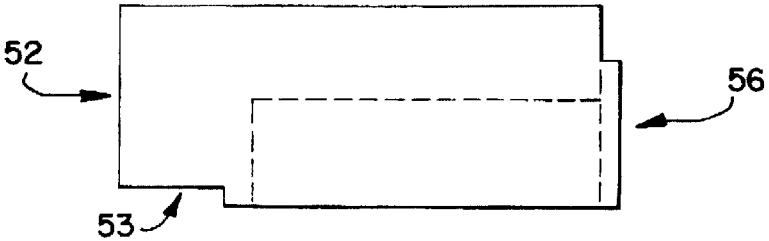
FIG. 10 is a schematic drawing of a side view of the top cup rotated 90 degrees off the top view of FIG. 8.

The jacket 30 protects the other elements from outside interferences. It is thus preferable to manufacture the jacket 30 from a rigid, conductive material such as a metal. Alternatively, the jacket 30 may be produced from a material coated with a conductive material. FIGS. 2 and 3 best illustrate the principal features of the jacket 30. A longitudinal axis 31 extends from a top portion 32 downward toward an opening 33 at the end opposing the top portion 32. A generally cylindrical shell 34 with a constant radius of curvature runs parallel to the longitudinal axis 31. The cylindrical shape of the shell 34 defines the opening 33 at the end opposing the top portion 32 where the shell 34 terminates.

The jacket 30 also provides the path by which acoustic energy enters the housing 12. This is accomplished by an acoustic input port 35 extending through the top portion 32. The acoustic input port 35 is generally characterized by a small round hole roughly in the center of the top portion 32. While it has been found that a single acoustic input port is preferable to reduce the effects of light entering the housing 12, other arrangements have been contemplated such as a plurality of holes and a larger acoustic input port covered by a screen.

Figure 12:
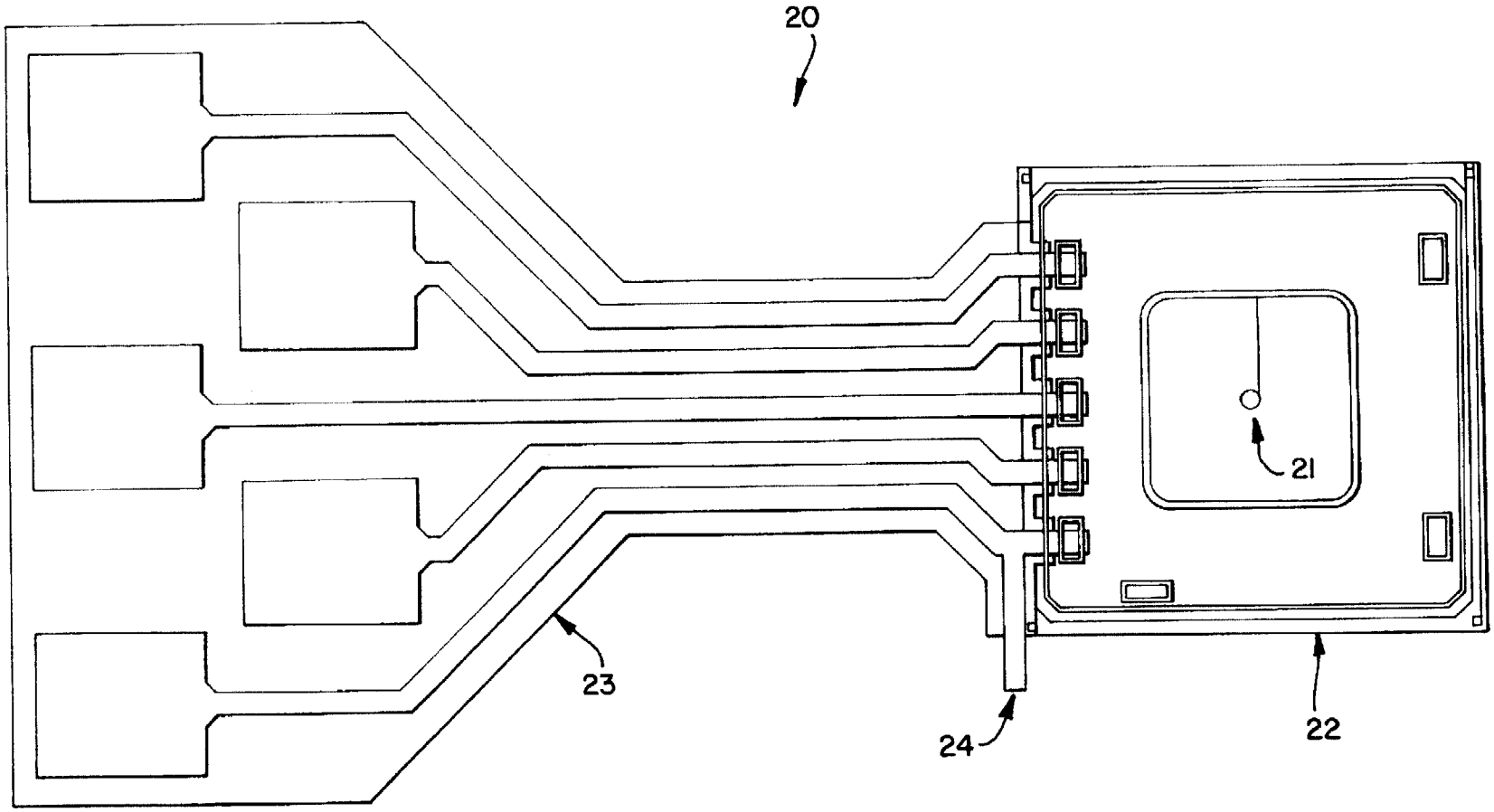
FIG. 12 is a schematic drawing of the miniature silicon condenser microphone without the housing.

It has been found that when the jacket 30 is produced from a metal, a dab of a conductive epoxy may be applied to a grounding tab 24 (See FIG. 12) located on the flexible circuit 23. The grounding tab 24 contacts the jacket 30 near the opening 33. The combination of the conductive epoxy and the tab 24 grounds the metal jacket 30 thus shielding the silicon die 22 from electromagnetic interferences. Alternatively, the grounding tab 24 and jacket 30 may be connected by a weld, a crimp, or any other method which produces the desired grounding effect.

Referring to FIG. 1, a bottom cup 40 sits below the silicon die 22. This bottom cup 40 provides an obstruction to light that may come in contact with the silicon die 22 and helps support the silicon die 22 within the jacket 30. This cup 40 may be constructed from any material capable of producing the desired results but is most preferably made from a plastic such as Valox 325. Referring now to FIGS. 4 through 7, a curved surface 41 with a radius of curvature approximating that of the cylindrical shell 34 contacts an inner surface 36 of the shell 34. At an end corresponding to the top portion 32, the bottom cup 40 includes a light barrier 42. The light barrier 42 shields the interior of the jacket 30 from light that may enter through the acoustic input port 35. A chamber 43 is formed between the upper surface 44 of the light barrier 42 and the lower surface 37 of the top portion 32. The chamber allows acoustic energy to travel from the acoustic input port 35 toward the interior of the jacket 30 where the transducer 21 is housed.

The chamber's height is controlled by a rim 45 located on the upper surface 44 of the light barrier 42. The rim 45 contacts the lower surface 37 of the top portion 32. This insures proper spacing between the top portion 32 and the light barrier 42 so that the chamber 43 is formed more precisely, and acoustic energy may travel more directly toward the interior of the jacket 30. In another embodiment, the upper surface features a plurality of rims **45*a*, 45*b* which funnel the acoustic energy toward the interior of the jacket 30**.

A support surface 46 is provided on the bottom cup 40. The silicon die 22 rests on the support surface 46 which aids in fixing the transducer 21 in the proper position within the jacket 30. The contact points on the silicon die 22 and the support surface 46 are sufficiently flat and smooth so that an acoustic seal, adequate for response at frequencies down to a few tens of Hertz, is formed between them. In the alternative, an epoxy may be added to maintain an adhesive seal between the silicon die 22 and the support surface 46 returning a similar result.

Near the opening 33 of the jacket 30, the bottom cup 40 is characterized by a sealing member 49. The sealing member 49 contacts the flexible circuit 23 at a lower edge 48 and blocks light from entering the jacket's opening 33.

The union of the silicon die 22 and the bottom cup 40 defines the back cavity 60. The back cavity 60 furnishes the pressure reference which allows the microphone to function properly as an omni-directional unit. A directional microphone can be built by venting the back cavity 60 opposite to the acoustic input port 35.

Referring again to FIG. 1, a top cup 50 sits above the silicon die 22. The top cup 50 aids in fixing the silicon die 22 in proper position and acts as a barrier to light. The top cup 50 may be manufactured from any material that is capable of performing these functions but is preferably produced from a plastic such as Valox 325. FIGS. 8 through 11 further illustrate the top cup 50. A curved outer surface 51 with a radius of curvature approximating that of the jacket's shell 34 contacts the inner surface 35 of the shell 34. The top cup 50 engages the flexible circuit 23 and the silicon die 22 at a closed end 52. The combination of the closed end 52, the flexible circuit 23 and the bottom cup's sealing member 49 seal the jacket from light that could disturb the silicon die 22.

The closed end 52 may include a vertical notch 53 parallel to the jacket's longitudinal axis 31. The flexible circuit 23 fits within the vertical notch 53. The union of the vertical notch 53 and the flexible circuit 23 create a seal through which light cannot travel.

The light seal at the jacket's opening 33 may be improved by adding an adhesive bead to either side of the flexible circuit 23. The adhesive bead bonds with the lower edge 48 of the sealing member 49 and the vertical notch 53 of the closed end 52. The resultant union of the three elements provides strain relief to the flexible circuit 23 as well as a complete light seal.

At an open end 54, the top cup 50 cooperates with the light barrier 42 to form an optical baffle 55. The optical baffle 55 provides the path by which the acoustic energy travels from the chamber 43 to the transducer 21 while at the same time prevents light from coming in contact with the silicon die 22.

In another embodiment, the open end 54 comprises a mating surface 56. The mating surface 56 is a raised portion which engages the under side of the light barrier to insure proper spacing of the optical baffle 55. In yet another embodiment, a plurality of mating surfaces **56*a*, 56*b* contact the under side 47 of the light barrier 42. The plurality of mating surfaces 56*a*, 56*b* form a channel 57 which more precisely directs the acoustic energy toward the interior of the jacket 30 and the transducer 21**.

Several methods can be utilized to fix the bottom cup 40, top cup 50, and silicon die 22 within the jacket 30. For instance, a friction between the cylindrical shell's inner surface and those elements can be produced which is great enough in magnitude to hold the elements in place. Alternatively, the jacket 30 could exhibit a peened section adjacent the jacket's opening. Such a peened section could provide enough pressure against the jacket's contents to hold them in position. Finally, an adhesive could be applied to the shell's inner surface to fix the bottom cup 40, top cup 50, and silicon die 22 within the jacket 30.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A housing for shielding a transducer of the type mounted on a silicon die attached to a flexible circuit, said housing comprising:

a jacket, said jacket having a longitudinal axis, a shell extending from a top portion, and an opening at an opposing end, said shell being substantially parallel to said longitudinal axis;

a bottom cup, said bottom cup engaging an inner surface of said shell and said transducer wherein said transducer is fixed within said jacket, and said bottom cup having a light barrier and a sealing member, said light barrier being positioned adjacent said top portion, and said sealing member being positioned at said opening; and, a top cup, said top cup engaging said inner surface of said shell, and said top cup having an open end which mates with said light barrier, and a closed end.

2. The housing of claim 1 wherein said top portion defines an acoustic input port, said acoustic input port allowing an acoustic energy to enter said jacket.

3. The housing of claim 2 including a rim on an upper surface of said light barrier, said rim engaging a lower surface of said top portion wherein a chamber is formed between said top portion and said light barrier.

4. The housing of claim 2 wherein said top cup comprises a mating surface, said mating surface engages an under side of said light barrier forming an optical baffle through which an acoustic energy travels.

5. The housing of claim 2 including a support surface on said bottom cup, said transducer being held in place by positioning said silicon die on said support surface wherein said silicon die and said bottom cup define a back cavity.

6. The housing of claim 5 wherein said closed end of said top cup includes a vertical notch, said vertical notch being parallel with said longitudinal axis and engaging said flexible circuit to hold said silicon die in position.

7. The jacket of claim 2 further comprising a peened section between said opening and said top portion, said peened section fixing said top cup and said bottom cup in position within said jacket.

8. The jacket of claim 2 wherein said top cup and said bottom cup are held in position within said jacket by friction.

9. The jacket of claim 2 including an adhesive applied to said inner surface of said shell, said adhesive fixing said top cup and said bottom cup in position.

10. The housing of claim 5 wherein an acoustic seal is formed between said support surface of said bottom cup and said silicon die.

11. The housing of claim 6 wherein an adhesive bead is applied to said flexible circuit to provide a light seal between said closed end of said top cup and said sealing member of said bottom cup.

12. The housing of claim 1 wherein said top and bottom cups are produced from a plastic.

13. The housing of claim 1 wherein said jacket is produced from a metal.

14. The housing of claim 1 wherein said jacket is coated with a conductive material.

15. The housing of claim 13 or 14 wherein said flexible circuit is grounded to said jacket.

16. The housing of claim 15 wherein a conductive epoxy is placed on a grounding tab on said flexible circuit, said grounding tab and said conductive epoxy engaging said jacket whereby said jacket is grounded.

17. The housing of claim 15 wherein a weld is placed on a grounding tab on said flexible circuit, said grounding tab and said weld engaging said jacket whereby said jacket is grounded.

18. The housing of claim 15 wherein a crimp is placed on a grounding tab on said flexible circuit and said jacket, said crimp providing an electrical contact whereby said jacket is grounded.

19. A housing for shielding a transducer of the type mounted on a silicon die attached to a flexible circuit, said housing comprising:

a jacket, said jacket having a longitudinal axis, a generally cylindrical shell extending from a top portion, and an opening at an opposing end, said generally cylindrical shell being substantially parallel to said longitudinal axis;

a bottom cup, said bottom cup having a curved surface for engaging an inner surface of said generally cylindrical shell, a light barrier, and a sealing member, said light barrier being positioned adjacent said top portion, and said sealing member being positioned at said opening, said bottom cup engaging said silicon die wherein said bottom cup and said silicon die define a back cavity; and, a top cup, said top cup having a curved outer surface for engaging said inner surface of said generally cylindrical shell, an open end which mates with said light barrier, and a closed end, said closed end engaging said transducer wherein said transducer is fixed within said jacket.

20. The housing of claim 19 wherein said top portion defines an acoustic input port, said acoustic input port allowing an acoustic energy to enter said jacket.

21. The housing of claim 20 including a rim on an upper surface of said light barrier, said rim engaging a lower surface of said top portion wherein a chamber is formed between said top portion and said light barrier.

22. The housing of claim 20 wherein said top cup comprises a mating surface, said mating surface engages an under side of said light barrier forming an optical baffle through which an acoustic energy travels.

23. The housing of claim 20 wherein said bottom cup includes a support surface whereby said transducer is held in place by positioning said silicon die on said support surface.

24. The housing of claim 23 wherein said closed end of said top cup includes a vertical notch, said vertical notch being parallel with said longitudinal axis and engaging said silicon die to hold said silicon die in position.

25. The jacket of claim 20 further comprising a peened section between said opening and said top portion, said peened section fixing said top cup and said bottom cup in position within said jacket.

26. The jacket of claim 20 wherein said top cup and said bottom cup are held in position within said jacket by friction.

27. The jacket of claim 20 including an adhesive applied to said inner surface of said generally cylindrical shell, said adhesive fixing said top cup and said bottom cup in position.

28. The housing of claim 23 wherein an acoustic seal is formed between said support surface of said bottom cup and said silicon die.

29. The housing of claim 24 wherein an adhesive bead is applied to said flexible circuit to provide a light seal between said closed end of said top cup and said sealing member of said bottom cup.

30. The housing of claim 19 wherein said top and bottom cups are produced from a plastic.

31. The housing of claim 19 wherein said jacket is produced from a metal.

32. The housing of claim 31 wherein a conductive epoxy is placed on a grounding tab on said flexible circuit, said grounding tab and said conductive epoxy engaging said jacket whereby said jacket is grounded.

33. A housing for shielding a transducer of the type mounted on a silicon die and connected to a flexible circuit, said housing comprising:

a jacket, said jacket having a longitudinal axis, a generally cylindrical shell extending from a top portion, and an opening at an opposing end, said generally cylindrical shell being substantially parallel to said longitudinal axis, and said top portion including an acoustic input port;

a bottom cup, said bottom cup having a curved surface for engaging an inner surface of said generally cylindrical shell, a light barrier, and a sealing member, said light barrier including a rim on an upper surface for engaging a lower surface of said top portion wherein a chamber is formed between said top portion and said light barrier through which an acoustic energy may travel, and said sealing member being positioned at said opening, said bottom cup engaging said silicon die wherein said bottom cup and said silicon die define a back cavity; and, a top cup, said top cup having a curved outer surface for engaging said inner surface of said generally cylindrical shell, an open end including a mating surface which engages an under side of said light barrier to form an optical baffle wherein said acoustic energy travels from said chamber through said optical baffle to contact said transducer, and a closed end which mates with said transducer wherein said transducer is fixed within said jacket.

34. The housing of claim 33 further comprising a support surface on said bottom cup wherein said silicon die may be held in place by positioning it on said support surface.

35. The housing of claim 34 further comprising a vertical notch on said closed end of said top cup, said vertical notch being substantially parallel to said longitudinal axis and engaging said silicon die to hold said silicon die in position.

36. The housing of claim 34 wherein an acoustic seal is formed between said support surface and said silicon die.

37. The housing of claim 35 wherein an adhesive bead is applied to said flexible circuit to provide a light seal at said opening of said jacket.

38. A miniature silicon condenser microphone comprising;

a transducer, said transducer being mounted on a silicon die and connected to a flexible circuit; and, a housing, said housing comprising, in combination, a jacket, said jacket having a longitudinal axis, a shell extending from a top portion, and an opening at an opposing end, said shell being substantially parallel to said longitudinal axis;

a bottom cup, said bottom cup engaging an inner surface of said shell and said transducer wherein said transducer is fixed within said jacket, and said bottom cup having a light barrier, and a sealing member, said light barrier being positioned adjacent said top portion, and said sealing member being positioned at said opening; and, a top cup, said top cup engaging said inner surface of shell, and said top cup having an open end which mates with said light barrier, and a closed end.

* * * * *